United States Patent [19]

Gorby

[11] 4,037,681

[45] July 26, 1977

[54] TOWABLE FRONT END LOADER

[75] Inventor: Oliver L. Gorby, Fargo, N. Dak.

[73] Assignee: Dynamic Industries, Inc., Barnesville, Minn.

[21] Appl. No.: 611,024

[22] Filed: Sept. 8, 1975

Related U.S. Application Data

[63] Continuation of Ser. No. 402,771, Oct. 2, 1973, abandoned.

[51] Int. Cl.[2] ..... B60K 17/34

[52] U.S. Cl. ..... 180/44 R; 180/51; 280/400

[58] Field of Search ..... 180/44 R, 44 F, 44 E, 180/51, 22; 74/342, 333; 280/400, 402

[56] References Cited

U.S. PATENT DOCUMENTS

| | | | |
|---|---|---|---|
| 2,300,502 | 11/1942 | Haltenberger | 180/44 R X |
| 2,306,902 | 12/1942 | Rabe | 74/342 X |
| 2,314,833 | 3/1943 | Keese | 180/44 R X |
| 3,101,150 | 8/1963 | Janson et al. | 180/44 R |
| 3,101,854 | 8/1963 | Kampert | 280/402 X |
| 3,521,720 | 7/1970 | Korotkin | 180/51 |

*Primary Examiner*—Joseph F. Peters, Jr.
*Assistant Examiner*—Terrance L. Siemens
*Attorney, Agent, or Firm*—Robert E. Kleve

[57] ABSTRACT

The invention comprises a front end loader having a disengagable drive in its gear box for free wheeling of the loader. The loader also has a towing arm mounted to its front for towing the loader on a roadway, with the wheels of the loader in free wheeling. The gear box is mounted directly in front of the rear axle of the loader.

3 Claims, 9 Drawing Figures

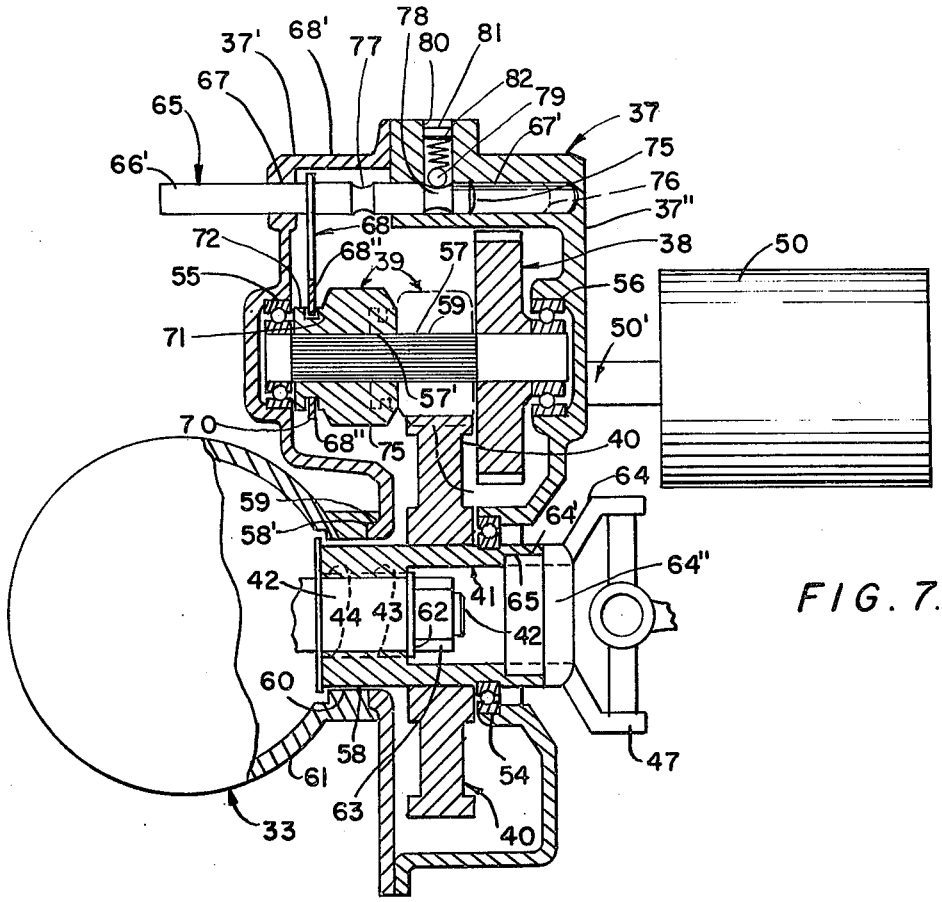
FIG. 7.
FIG. 8.
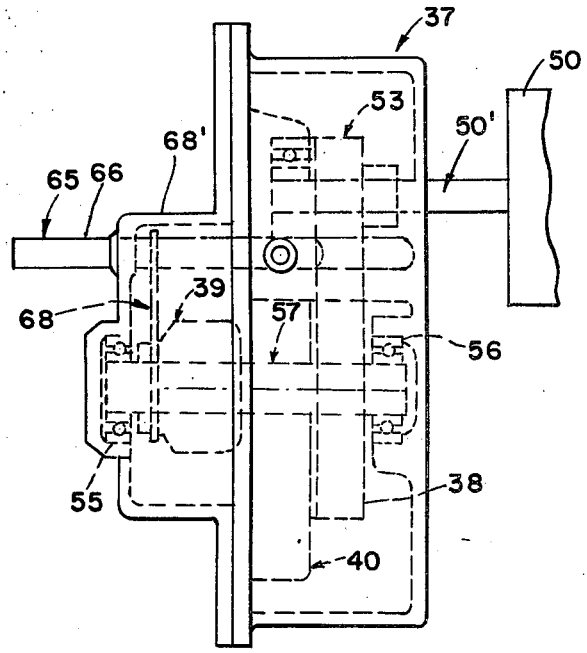
FIG. 9.
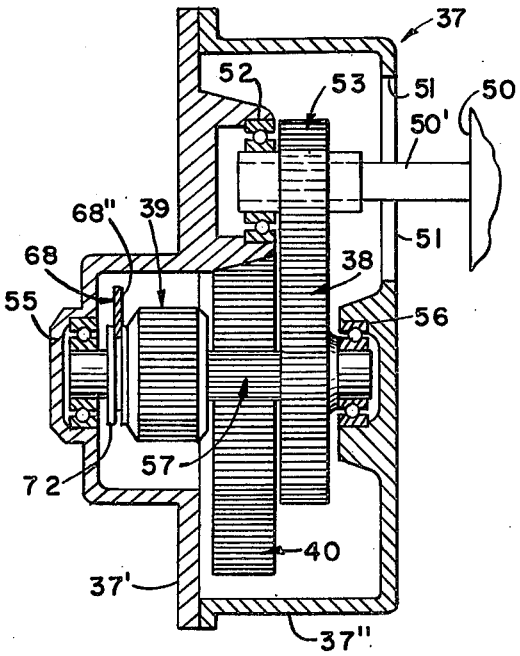

TOWABLE FRONT END LOADER

This is a continuation of application Ser. No. 402,771, filed Oct. 2, 1973, now abandoned.

This invention relates to front end loaders. This application is also related to an earlier co-pending U.S. patent application Ser. No. 256,677, filed, May 25, 1972, entitled Front End Loader, of which I am one of the inventors.

It is an object of the invention to provide a novel front end loader which may be towed behind an automobile or other vehicle upon a roadway at relatively high speeds, with the wheels of the front end loader in free wheeling.

It is another object of the invention to provide a novel front end loader having gear box with a disengageable gear to disengage the drive to the wheels of the loader, so the wheels of the loader may be free wheeling, and which has a towing arm adapted to be mounted to the front of the loader for towing the loader behind a vehicle.

It is another object of the invention to provide a novel improved gear box for a front end loader.

It is another object of the invention to provide a novel gear box for a front end loader which has a disengagable gear for disengaging the power drive between the motor and drive wheels of the loader, whereby the loader may be towed behind a vehicle at relatively high speed with the wheels of the loader being in free wheeling.

Further objects and advantages of the invention will become apparent as the description proceeds and taken in conjunction with the accompanying drawings wherein:

FIG. 7 is a cross-sectional view taken along line 7—7 of FIG. 5 and illustrating the interior structure of the gear box, with the movable gear shown in an engaged drive position in solid lines, and shown in a disengageable position in dashed lines.

FIG. 8 is a top plan view of the reduction gear box.

FIG. 9 is a top cross-sectional view of the gear box.

Briefly stated, the invention comprises a front end loader having a novel reduction gear box said gear box has an intermediate gear in its gear train which is disengagable to disengage the drive between the motor for driving the loader and the drive wheels of the loader. The disengagement of the intermediate gear provides free wheeling for the loader. A towing arm is mounted to the front of the loader which arm has a socket connection for attachment to the ball hitch of a towing vehicle for towing vehicle for towing the loader while the loader is in free wheeling condition by the disengagement of the gear.

Figure 1:
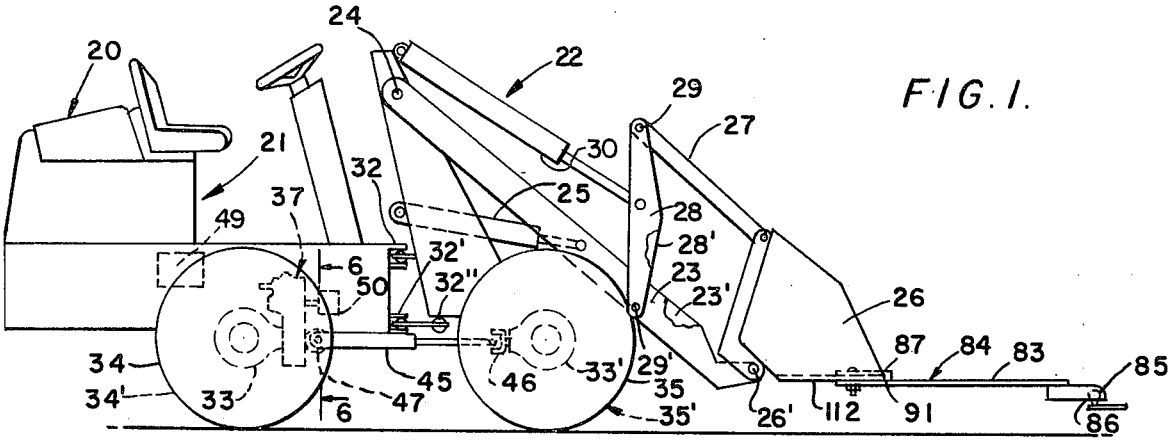
FIG. 1 is a side elevational view of the front end loader for towing on a roadway with the gear box drive disengaged for free wheeling of the loader and with the tow arm attached for towing.
Figure 2:
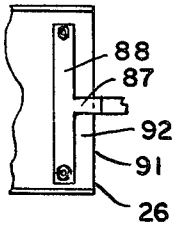
FIG. 2 is a fragmentary top plan view of the bucket of the loader and the towing arm.
Figure 3:
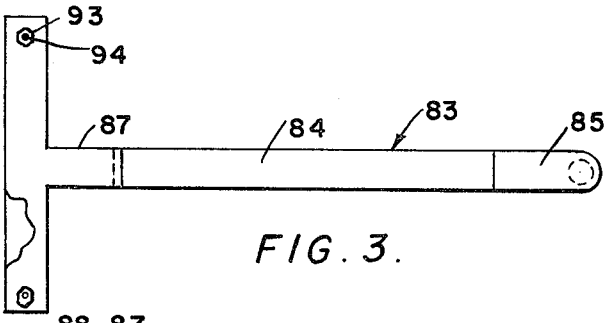
FIG. 3 is a top plan view of the towing arm.
Figure 4:
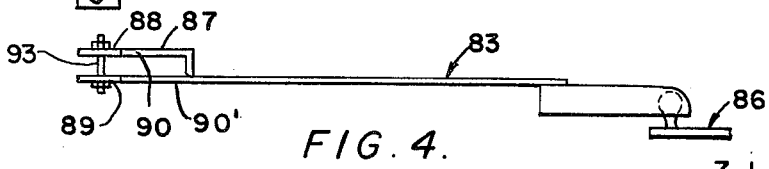
FIG. 4 is a side elevational view of the towing arm.
Figure 5:
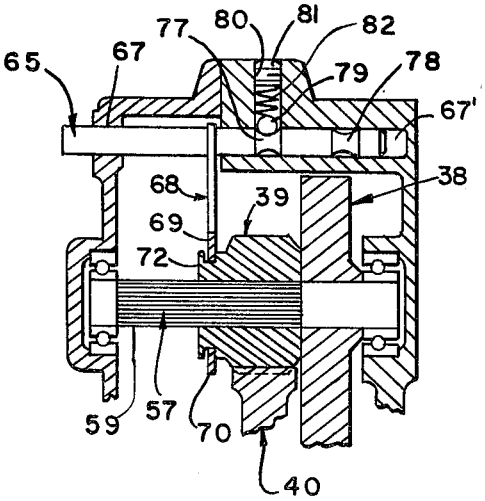
FIG. 5 is a cross-sectional view taken along line 5—5 of FIG. 1 illustrating the front of the reduction gear box.

Referring more particularly to the drawings in FIG. 1, the novel front end loader device is illustrated in a condition for towing behind a vehicle not shown.

The front end loader 20 is illustrated as having conventional front and rear frame 21 and 22, with a lifting arms 23 and 23' mounted to the front frame. The lifting arms are pivoted about pivot points 24 by a hydraulic cylinder and piston 25, pivotally connected at its end between the lifting arms and front frame in a conventional manner. A bucket 26 is pivotally mounted to the front of the lifting arms 23 and 23' about axis 26'. A pivot plate 27 is pivotally connected at its one end to a bucket 26 and pivotally connected at its other end to a pair of arms 28 and 28' at pivot point 29. The other end of the arms 28 and 28' are pivotally connected to the lifting arms 23 and 23' at pivot point 29'. An hydraulic cylinder 30 is pivotally connected at its ends between the front frame and arms 28 and 28' to pivot the bucket about the axis 26' in a conventional manner. A hydraulic cylinder and piston is provided pivotally mounted at its ends between the front and rear frames to pivot the front frame relative to the rear frame about three articulated or uniball joints 32, 32', and 32''.

A pair of rear and front axles 33 and 33' are mounted to the rear and front frames 21 and 22, respectively, a pair of wheels 34 and 34' are mounted to the rear axle and a pair of wheels 35 and 35' are mounted to said front axles.

While the specification describes one form of articulated joint for an articulated front end loader, this form is now well known and this form is not being claimed as a part of the invention in this application; as the disengagable gear box and towing arm invention is adaptable to various other conventional types of articulated front end loader.

A gear box 37 having a plurality of reduction gears 38, 39, and 40 are rotatably mounted inside the housing of the gear box 37 and are engaged together in a train to provide a gear reduction. The gear box 37 is mounted directly to the front of said rear axle 33. The gear 40 has a sleeve portion 41 attached to the center of the gear 40. The input shaft 42 of the rear axle passes directly through the sleeve 41 of gear 40. The sleeve portion 41 of gear 40 has a plurality of radially opposed slots 43 and the input shaft 42 has a plurality of radially projecting tongues 44 which are slidably received in the slots 43 of the sleeve portion of gear 40 to attach the gear 40 to the input shaft 42 by a spline connection, so that gear 40 and input shaft 42 rotate together to provide a drive connection between the last gear 40 of the gear train of the gear box and the rear axle input shaft.

A conventional splined telescoping drive shaft 45 has its front end member attached to the input shaft of the front axle by a Universal joint 46. The rear end member of the telescoping drive shaft has an universal joint 47 which connects the telescoping drive shaft to the sleeve 41 of the input shaft.

A gasoline motor is mounted to the rear frame. The gasoline motor powers hydrostatic pump 49 is also mounted to the rear frame, and the hydrostatic pump 49 drives a hydrostatic motor 50 which is also mounted to the rear frame.

The gear box 37 has a gear box housing formed of a rear plate or shell 37' and a front plate or shell 37''.

The hydrostatic motor 50 has an output shaft 50' which projects into the gear box housing through an opening 51. The motor 50 is rigidly mounted to the gear box housing by conventional brackets (not shown). The shaft 50' is rotatably supported at its outer end by a ball bearing member 52 which ball bearing member is attached to the rear plate of the gear box housing 37. A gear 53 is fixed to the output shaft 50', so that shaft 50' drives gear 53 and gear 53 and engages the gear 38 of the gear box. The gasoline motor powers the hydrostatic pump 49. The pump 49 powers the hydrostatic motor 50. The motor 50 through its output shaft 50' drives small gear 53 which drives relatively large gear 38. The large gear 38 is fixed to a shaft 57 and shaft 57 rotates with gear 38. The gear 39 rotates with shaft 57 when gear 39 is in its position shown in solid lines in FIG. 6 and engages and drives relatively large gear 40 to provide a power drive reduction from the hydrostatic motor 50 to the gear 40 and gear 40 drives connecting shafts 42 and 45 to drive the front and rear axles 33 and 33' which in turn drive the wheels of the loader from powering the movement of the loader along the ground.

The shaft 57 has its outer ends rotatably supported in ball bearing members 55 and 56 which members are housed in the front and rear housing plates, respectively of the gear box to attach the gear box to the rear axle. The sleeve or hub portion 41 of gear 40 is rotatably supported at its outer end by ball bearing member 54. The gear box housing has an annular opening 58 with a projecting annular ridge 58' which fits into an annular groove 59 in the annular opening 60 in the forward end of the rear axle housing 61 of the rear axle 33. A washer 62 is slid over the outer end of the shaft 42 and a nut 63 is threaded onto the shaft 42 against the washer 62. Within the bore portion 41' to lock the sleeve 41 axially to the input shaft 42 with the gear box housing 37' directly abutting the axle housing 61. The attachment of the nut 63 to retain the gear box housing and output drive to the rear axle housing and input drive.

The gear box 37 may be removed from the rear axle 33 by detaching the gear box from the hydrostatic motor and rear frame. Thereafter, the nut 63 will be unthreaded and the washer 62 removed. This enables the sleeve or hub portion 41 of gear 40 to be slid off the shaft 42 by being slid along the longitudinal axis of the input shaft with the slotted portion 43 sliding out of the tongue portion 44 and with the gear housing ridge 58' sliding out of the annular groove 59 in the rear axle housing 61 of the rear axle 33.

The rear universal joint 47 has a yoke 64. The yoke 64 has a reduced cylindrical portion 64' which is filled into a cylindrical recess 65 in the sleeve 41. The yoke 64 may be also suitably welded to the sleeve or hub portion 41 of gear 40. The yoke has a bore 64" therethrough.

Consequently, the rotation of sleeve 41 of gear 40 rotates the universal joint 47 and the universal joint rotated the conventional splined telescoping drive shaft 45 which drive at its forward end is connected to be universal joint 46. The universal joint 46 rotates the input shaft of the front axle 33' and drives the front axle gearing and the front axle gearing which inturn drives the front wheels 35 and 35'.

Also, the rotation of sleeve 41 and gear 40 rotating the input shaft 42 of the rear axle which drives the rear axle which inturn drives the rear wheels 34 and 34'.

The disengagable gear box and towing mechanism 20 is described as follows:

GEAR SHIFT MECHANISM

The gear box 37 has a slidable pin mechanism 65 with a slidable pin 66 which is slidably mounted in bores 67 and 67' of the housing members 37' and 37" of the gear box housing.

The slidable pin 66, in sliding, acts to shift gear 39 in the housing. When gear 39 is shifted by pin 66 into engagement to gear 40, power is provided between the hydrostatic motor 50 and the wheels of the loader for powering the loader. When gear 39 is shifted by pin 66 to disengage from gear 40, the loader is free wheeling, since gear 40 is free to rotate in response to the wheels rotating and driving the front and rear axles and the drive shafts 42 and 46 between the front and rear axles.

The slidable pin 66 has a downward projecting plate 68, with the upper end 68' fixed to the pin 66 and the lower end 68" of the plate 68 has a forked lower end with legs 69 and 70 slidably engaged in an annular groove 71 on opposite sides of an annular collar portion 72. The annular collar 72 is fixed directly to the gear 39.

The forked lower end of plate 68 enables gear 39 and its collar portion 72 to rotate freely relative to plate 68, while the legs remained engaged in the annular groove, so that pin 66 slides plate 68 and plate 68 slides the gear 39 and its collar portion 72 along shaft 57, while gear 39 and its collar portion is free to rotate relative to plate 68.

Gear 39 and its collar portion 72 have a spline connection with shaft 57, so that gear 39, along with its collar portion 72 is slidable along shaft 57, although gear 39 and shaft 57'must rotate together.

The gear 39 has a splined center bore and the shaft 57 has a splined outer diameter or outer circumference 57 so that gear 39 may slide axially, in response to the movement of the pin 66 and its plate 68, along shaft 57 from its position shown in solid lines in FIG. 7 to its position shown in dashed lines in FIG. 7 (solid lines in FIG. 6), or visa versa to engage or disengage the gear train of the gear box.

Figure 6:
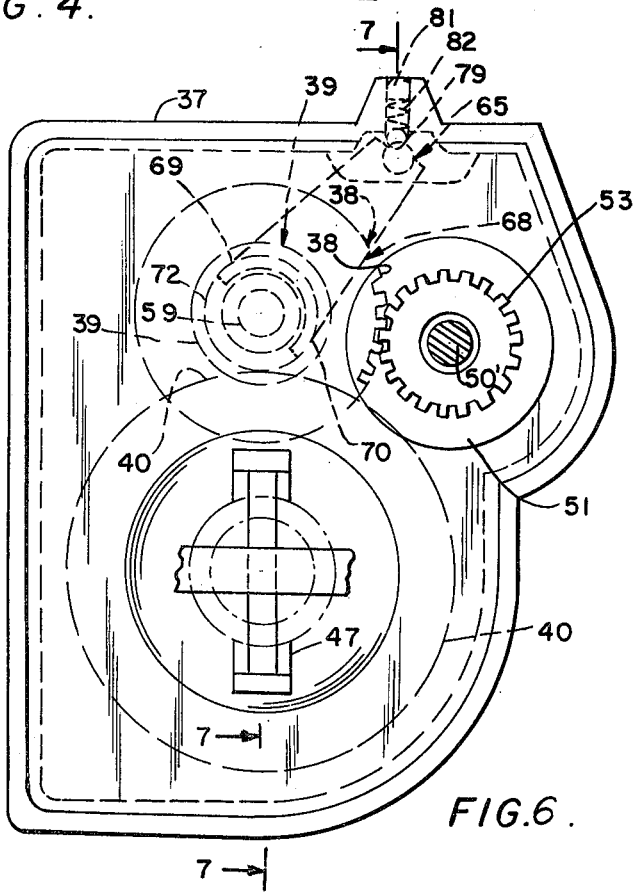
FIG. 6 is a fragmentary cross-sectional view illustrating the movable gear in an engaged drive position.

Thus, when gear 39 is slid into engagement with gear 40, as illustrated in FIG. 6, power is transmitted from the hydrostatic motor 50, through its output shaft 50' to gear 53 of the gear box, rotating gear 53. Gear 53 drives gear 38, gear 38 rotates shaft 57, which inturn drives or rotates the shiftable gear 39. The shiftable gear 39 inturn drives gear 40 of the gear box.

Gear 40, inturn, hub portion 41 fixed thereto rotates its hub portion 41, which inturn rotates the input shaft 42 of the rear axle to drive the rear axle which inturn drives the rear wheels.

Gear 40, through its hub portion 41, which hub portion also has one joint of the universal joint 47 fixed thereto, thereby drives or rotates the universal joint 47 which drives the telescoping drive shaft 45, which drives the front axle 33, which inturn drives the front wheels.

Thus, the hub portion 41 of gear 40 transmitts drive in two directions, to the rear axle in one direction, through its spline connection with the input shaft 42, and to the front axle in the other direction, through universal joint 47, drive shaft 45 and front universal joint 46, for driving the rear and front wheels of the loader.

A spring loaded ball mechanism acts to lock the rod 66 in either position. The rod or pin 66 of the shiftable gear mechanism has a pair of annular grooves 77 and 78, and a steel ball 79 is slidably mounted in a bore or passageway 80 of the housing member 37" which passageway extends laterally down to pin 66. A threaded plug 81 is threaded into the housing plate 37" at the upper end of the passageway 80 and engage a coil spring 82 which spring is also in the passageway. The plug when threaded into the passageway a distance compresses the spring 82 and the spring engages against the ball 79 to urge the ball 79 against the pin 66.

When the pin 66 is slid axially in the bores 67 and 67' to the right when viewed from FIG. 6 and FIG. 7 from its position 75 shown in solid lines in FIG. 7 to its position 76 shown in phantom lines in FIG. 7, the movement of pin 66 moves the plate arm 68. The plate arm, through its engagement with the collar portion 72 of gear 39, moves gear 39 along shaft 57 from its position shown in solid lines in FIG. 7 to their position 76 shown in phantom lines in FIG. 7 which places the gear 39 in engagement with gear 40 for powering the loader.

When pin 66 reaches position 76 the spring 82 urges the ball 79 in the annular groove 77 with sufficient force to hold the pin at position 76 maintain the gear 39 in engagement with gear 40, so that the gasoline motor now drives the hydrostatic pump 49. The pump drives the hydrostatic motor which rotates the output shaft 50' of the hydrostatic motor which rotates the gear 53 fixed to the output shaft. The gear 53 rotates gear 38, gear 38 inturn rotates gear 39, gear 39 inturn rotates gear 40, and gear 40 will drive the input shaft or drive shaft 42 of the rear axle to drive the rear axle, and gear 40 will also drive the drive shaft 46 to drive the front axles, which axles inturn will drive the wheels of the loader to propell the loader along the ground for such various working operations as it may be employed for.

When pin 66 is slid axially in the bores 67 and 67' to the left when viewed from FIGS. 6 and 7 from its position 76 shown in phantom lines in FIG. 7, to its position 75, shown in solid lines in FIG. 7, the movement of the pin 66 moves the plate 68, and the plate arm 68 through its engagement with the collar portion 72 of gear 39 moves to the left, when viewed from FIG. 7, from its position shown in phantom lines in FIG. 7 to its position shown in solid lines in FIG. 7, which places gear 39 out of engagement with gear 40 for towing the loader.

When pin 66 reaches its position 75, the annular groove 78 is aligned beneath the ball 79, and the spring 82 urges the ball 79 into the annular groove 78 and holds the ball in the annular groove 78 so that gear 39 is held out of engagement with gear 40. The spring action will be sufficient to hold the pin in its position 75 so that gear 39 will be held out of engagement with gear 40 and consequently the front and rear wheels will be free wheeling for towing, since the wheels, front and rear axles, output shaft, and drive shaft, and gear 40 are free to rotate being free of gears 39, 38, and 54, the hydrostatic motor, pump, and gasoline motor.

To move the pin 66, plate 68, and gear 39 to either of their positions 75 and 76, the operator may physically grasp or with a suitable tool engage the outer end 66' of the pin 66 and physically overcome the spring loaded ball engagement in either groove, and will slide the pin axially to either position 75 and 76 causing the ball to slide upward in the passageway 80 until the ball is out of one particular annular groove 77 and 78 and will move the pin to align with the other of the two grooves 77 and 78 at which time the ball will be pushed back into the aligned groove.

TOWING ARM

When towing the loader 20 the towing arm 83 will normally be used. The towing arm 83 has an elongated rod 84 with a conventional hitch socket 85 fixed to one end of the rod, for a swivel or ball and socket connection with a ball 86. The ball 86 is mounted to the rear of a towing vehicle.

At the rear end of the rod 84 is a forked member 87. A pair of lateral plates 88 and 89 which are welded laterally across the ends of the legs 90 and 90' of the forked member 87 in spaced relation.

The spaced plates 88 and 89 are spaced sufficiently far apart from one another to slide over the front edge 91 of the front bottom plate 92 of the bucket and onto opposite sides of the plate 92. Bolts 93 are inserted into bores in the plates 88 and 89 and through bores in the bottom plate 92 of the bucket and nuts 94 are threaded onto the bolts 93 to lock the plates 88 and 89 and arm 83, and thereby lock the towing arm 83 to the bucket.

Thus, the towing arm when attached will be fixed at one end to the bucket and attached through a swivel connection at the other end to the towing vehicle.

When it is desired to tow the loader on a roadway the towing arm 83 will be attached to the front of the bucket of the loader and the hitch socket 85 will be attached to the ball 86 at the rear of the towing arm vehicle.

Also, the pin 66 of the gear box will be shifted to its position 75 to disengage the gear 39 from the gear 40 of the gear train of the gear box.

The disengagement of the gear 39 provides free wheeling for the loader and is necessary when it is desired to tow the loader, as the motor and hydrostatic motor of the loader will be turned off during towing which for all practical purposes acts to freeze the wheels and drive of the loader if the gear 39 is not disengaged. The disengagement enables the wheels of the loader to roll on the ground at much higher speeds than if the loader were being driven self propelled. The loader in its free wheeling or towing condition may be towed up to speeds of 50 mph. with ease and without any damage to the front or rear axles, or drive shaft, or gear 40 of the gear box.

The gear box 37 and its gearing or gear train is designed only for speeds in the neighborhood of 8–10 mph. at the highest when the loader is operating in its self propelled condition by the gasoline motor driving the hydraulic motor and the hydraulic motor inturn driving the gears of the gear box, which inturn drive the front and rear axles of the loader to drive the wheels of the loader to self propel the loader for normal operation and use of the loader.

When the towing of the loader is complete and it is desired to use and operate the loader as a self propelled loader, with the motor of the loader propelling the loader, the towing arm 83 will be removed from the bucket, and the pin 66 of the gear box will be shifted or slid to its position 76 which reengages gear 39 with gear 40 again, so that the loader can operate in its self propelled condition.

Also, since the gear box of the loader is pivotally designed for the reduction gears 38 and 39 to normally rotate at a speed so as to drive the wheels of the loader at only 8–10 mph., it is desirable to disengage gear 39 so that most of the gear train of the gear box is disengaged during the towing operation or free wheeling operation, to prevent undue strain upon the gears of the gear box during high speed towing.

Also, when pin 66 is disengaged, the wheels easily and with relatively little drag, since the wheels, in rotation, need to only drive the front and rear axles, the connecting drive shafts and gear 40, which components can be rotated with relative ease.

The front and rear axle drive and drive shaft and gear 40, however, are designed to operate at low or high speeds without undue strain upon the front and rear axles and drive shafts are of conventional construction.

When the loader device is being towed with the gear 39 disengaged, and the towing arm attached between the bucket of the loader and the towing vehicle, the loader will be towed from left to right when viewed from FIG. 1. Also the hydrualic cylinders 25 and 30 will be in the conventional inactive locked condition, in their position shown in FIG. 1, so that their piston cannot move relative to their cylinder portions.

Also, the conventional hydraulic cylinder connected between the front and rear frames, used for turning, will be locked so that the front and rear frames are aligned along a straight line, although in some larger models, it may be desirable for the turning cylinder to be free floating to a certain extent to facilitate turning the loader while being towed.

It will be obvious that various changes and departures may be made to the invention without departing from the spirit thereof and it is not intended that the invention is to be limited to that specifically described in the specification or as illustrated in the drawings, but only as set forth in the claims appended hereto:

What is claimed is:

1. A front end loader device for towing comprising a front and rear frame, a pivotal activated connection between the front and rear frame, front and rear axles mounted to the front and rear frames, a pair of drive wheels mounted to said front and rear axles, a gear box having a plurality of reduction gears thereon engaged in a train to provide a gear reduction, said plurality of reduction gearing comprising a first input gear, intermediate reduction gears, and an output gear, said gear box being mounted to the front of said rear axle of said rear frame, a drive shaft connecting said output gear of said gear train to said rear axle, a drive shaft connecting said output gear to said front axle through universal joints, motor means connected to and powering said input gear whereby said intermediate reduction gears provides a reduced rotational speed to said output gear and to said drive shaft to drive said front and rear wheels of said loader to power the movement of said loader at very low speed, means to disengage at least one of said intermediate gears from said output gear to provide free wheeling of the wheels of the loader at relatively high speeds with said at least one of the intermediate and the input gear disengaged from the output gear during free wheeling to prevent their rotating with the output gear during free wheeling, said front frame having lifting arms mounted thereto with hydraulic cylinder means to raise and lower said lifting arms, a bucket mounted to said lifting arms at the outer ends, means to maintain said lifting arms with said bucket spaced above the ground, a tow arm having its one end attached to said bucket and its other end adapted to be attached to a towing vehicle for towing the loader in free wheeling by pulling the loader through the tow arm attachment to the bucket.

2. A four wheel drive front end loader device towable in free wheeling comprising a front and rear frame, front and rear axles mounted on said front and rear frames, respectively, said axles each having input shaft and output shafts, a pair of drive wheels mounted on said output shafts of said rear axle and a pair of drive wheels mounted on said output shafts of said front axle, a gear box mounted on said rear frame, said input shaft of said rear axle extending forwardly through said gear box, said gear box including a relatively small first gear, a relatively large second gear, a relatively small third gear, and a relatively large fourth gear, motor means connected to and powering said first gear, said second and third gears being mounted coaxially on a shaft to rotate together, said fourth gear being mounted on said input shaft of said rear axle, drive shaft means connecting coaxially to said input shaft at the front of said gear box at one end connected coaxially to the input shaft of said front axle at its other end through universal joint, said first gear being in driving engagement with second gear at their outer circumferential edges, said second gear being rotatable with said third gear on said shaft, to provide a gear reduction, said third gear being in driving engagement with said fourth gear at their outer circumferential edges, whereby said motor means powers first gear to produce a gear reduction drive to said fourth gear, and said fourth gear drives said input shafts of said rear axle, and said drive shaft means of said first axle to simultaneously drive said front and rear axle to simultaneously drive said front and rear wheels, disengagable means to disengage only said third gear from said fourth gear to simultaneously provide free wheeling to said fourth gear, said drive shaft means, input shaft and output shaft of said front and rear axles, and said front and rear wheels of said loader for towing said loader, said disengagable means including means slidably mounting said third gear on said shaft for axially movement, said disengageable means further including a movable pin means movable on said gear box having its outer end at least partially collaring one edge of said third gear to connect said pin means to the said third gear, said pin means being movable to slide said third gear axially on said shaft for said disengagement and engagement with said fourth gear, said pin means having portions projecting out of said gear box for actuating said disengagement and engagement from the exterior of said box, means to retain said third gear in its reengaged or disengaged position, a tow arm mounted to the front of said loader, means connecting said tow arm to a towing vehicle, whereby said towing vehicle may tow said loader with the wheels of said loader in free wheeling.

3. A towable front end loader according to claim 2 wherein said loader device includes a bucket lifting means mounted on the front frame, said bucket lifting means projecting outward and forward from the front frame and including lifting arms mounted to the front frame and a bucket mounted to the lifting arms, with said tow arm mounted to the outer end of the bucket lifting means for said towing of the loader.

* * * * *